US007055427B2

(12) United States Patent
Caron

(10) Patent No.: US 7,055,427 B2
(45) Date of Patent: Jun. 6, 2006

(54) MEDIA EMBELLISHING DIE

(75) Inventor: James Caron, Solon, OH (US)

(73) Assignee: Spellbinders Paper Arts, Co. LLC, Phoenix, AZ (US)

( * ) Notice: Subject to any disclaimer, the term of this patent is extended or adjusted under 35 U.S.C. 154(b) by 0 days.

(21) Appl. No.: 10/814,004

(22) Filed: Mar. 31, 2004

(65) Prior Publication Data

US 2005/0022681 A1 Feb. 3, 2005

Related U.S. Application Data

(60) Provisional application No. 60/541,478, filed on Feb. 3, 2004, provisional application No. 60/491,868, filed on Aug. 1, 2003.

(51) Int. Cl.
*B44B 5/02* (2006.01)
*B44C 1/24* (2006.01)
*B31F 1/07* (2006.01)

(52) U.S. Cl. ..... 101/26; 101/28; 101/30; 101/32

(58) Field of Classification Search ..... 101/8, 101/9, 5–7, 25, 27–28, 31, 379
See application file for complete search history.

(56) References Cited

U.S. PATENT DOCUMENTS 2,056,321 A * 10/1936 Haumont ..... 76/107.8
2,906,197 A * 9/1959 Priesmeyer ..... 101/28
3,584,522 A * 6/1971 Smafield ..... 408/16
3,936,384 A * 2/1976 Williams ..... 510/148
3,946,195 A * 3/1976 Lyons et al. ..... 219/216
4,257,251 A * 3/1981 Jury ..... 72/57
4,328,067 A * 5/1982 Cesano ..... 156/511
4,361,085 A 11/1982 Schutz
4,386,123 A * 5/1983 Coburn, Jr. ..... 428/29
4,503,110 A * 3/1985 Skene ..... 428/164
4,867,057 A * 9/1989 Bradley et al. ..... 101/27
4,928,588 A * 5/1990 Mathis ..... 101/9
5,722,319 A * 3/1998 Hirano ..... 101/23
6,007,754 A * 12/1999 Crawford et al. ..... 264/219
6,186,936 B1 * 2/2001 Smith et al. ..... 493/338
6,444,075 B1 9/2002 Schneider et al.
6,582,615 B1 * 6/2003 Hutchison et al. ..... 216/9
6,766,733 B1 * 7/2004 Collins ..... 101/28
2001/0000860 A1 5/2001 Smith et al.
2004/0118304 A1 6/2004 Corcoran et al.

FOREIGN PATENT DOCUMENTS

JP 08090720 A * 4/1996
JP 10199360 A * 7/1998

* cited by examiner

*Primary Examiner*—Daniel J. Colilla
(74) *Attorney, Agent, or Firm*—Fay, Sharpe, Fagan, Minnich & McKee, LLP

(57) ABSTRACT

A new and improved embellishing die and system and method for embellishing media is provided. The embellishing die includes a first side having a first embellishing surface and a second side having a second embellishing surface. The first and second sides can be on opposite sides of the die. The first and second embellishing surfaces can each include a cutter for cutting the media, or an embossing surface for embossing the media. The first embellishing surface can include an embossing surface for embossing the media and the second embellishing surface can include a cutter for cutting the media. The system can include the embellishing die and a press for pressing media against the media embellishing die to embellish the media.

30 Claims, 3 Drawing Sheets

MEDIA EMBELLISHING DIE

CROSS REFERENCE TO RELATED APPLICATIONS

This application claims the benefit of U.S. Provisional Application No. 60/491,868 filed Aug. 1, 2003 which is hereby incorporated by reference herein and U.S. Provisional Application No. 60/541,478 filed Feb. 3, 2004 which is hereby incorporated by reference herein.

BACKGROUND

The present invention relates to a system and method of embellishing media, and more particularly to a media embellishing die.

The papercraft and scrapbook industry has become widely popular seeing explosive growth in recent years. Many people have taken up the hobby of keeping mementos and photos in scrapbooks and they wish to personalize their collections using embellished media.

Typical known systems for embellishing media use a press for pressing the media against a die to embellish the media. These systems use a die having an embellishing surface on one side. The press presses the media against the embellishing surface to emboss or cut the media. A single die having only one embellishing surface can only perform one function such as embossing a media. To cut out the embossed media, a different die is required. It is desirable to reduce the cost and complexity of these known systems for embellishing media.

SUMMARY OF THE INVENTION

According to the present invention, a new and improved embellishing die for embellishing media is provided.

In accordance with a first aspect of the invention, the embellishing die includes system includes a first side having a first embellishing surface and a second side having a second embellishing surface. The first and second sides can be on opposite sides of the die.

In accordance with a second aspect of the invention, the first embellishing surface includes a cutter for cutting the media and the second embellishing surface includes a cutter for cutting the media.

In accordance with a another aspect of the invention the first embellishing surface includes an embossing surface for embossing the media and the second embellishing surface includes an embossing surface for embossing the media.

In accordance with a yet another aspect of the invention the first embellishing surface includes an embossing surface for embossing the media and the second embellishing surface includes a cutter for cutting the media.

In accordance with a another aspect of the invention a system for embellishing media is provided. The system includes a media embellishing die including a first side having a first embellishing surface for embellishing media and a second side having a second embellishing surface for embellishing media, and a press for pressing media against the media embellishing die to embellish the media. The first and second sides can be on opposite sides of the die.

The advantages and benefits of the present invention will become apparent to those of ordinary skill in the art upon reading and understanding the following detailed description of the preferred embodiments.

BRIEF DESCRIPTION OF THE DRAWINGS

The invention may take form in certain components and structures, preferred embodiments of which will be illustrated in the accompanying drawings wherein.

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific examples and characteristics relating to the embodiments disclosed herein are not to be considered as limiting, unless the claims expressly state otherwise.

The term "embellish" as used herein refers to altering the appearance of media by cutting the media and/or by embossing the media. The term "embossing" as used hereinafter refers to forming a three dimensional impression of a template in the media. The template can be a media embellishing die or any three dimensional object capable of embossing the media. The embossing is preferably dry embossing which does not use heat. The media can be any material suitable for embellishing including, but not limited to, paper, cardboard, metal, such as for example metal foil or other thin metals, and plastic.

Figure 1:
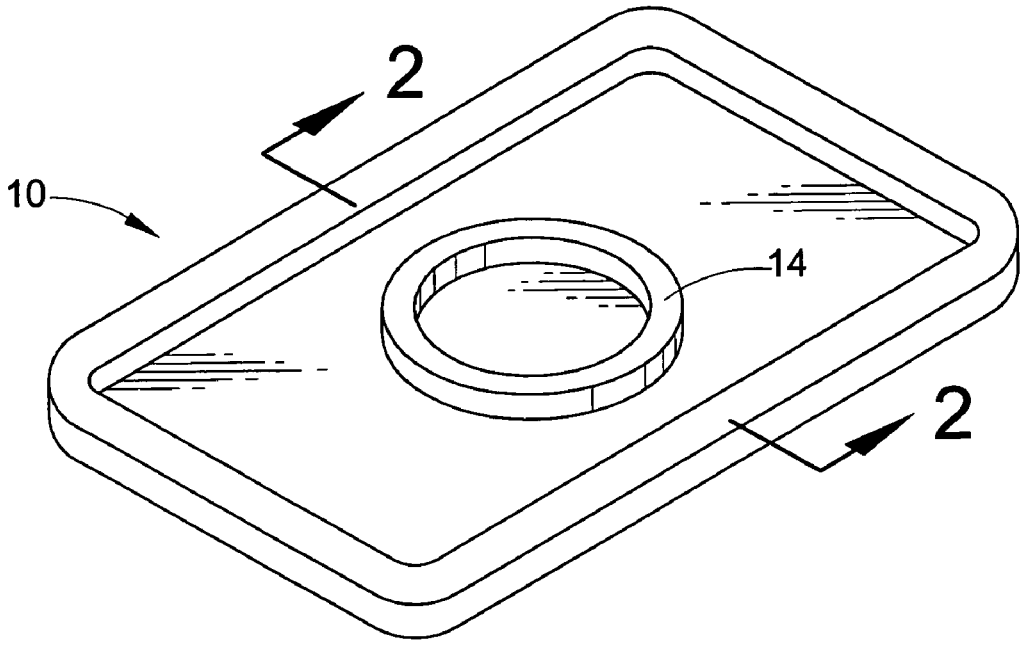
FIG. 1 is a perspective view illustrating an embellishing die in accordance with the invention.
Figure 2:
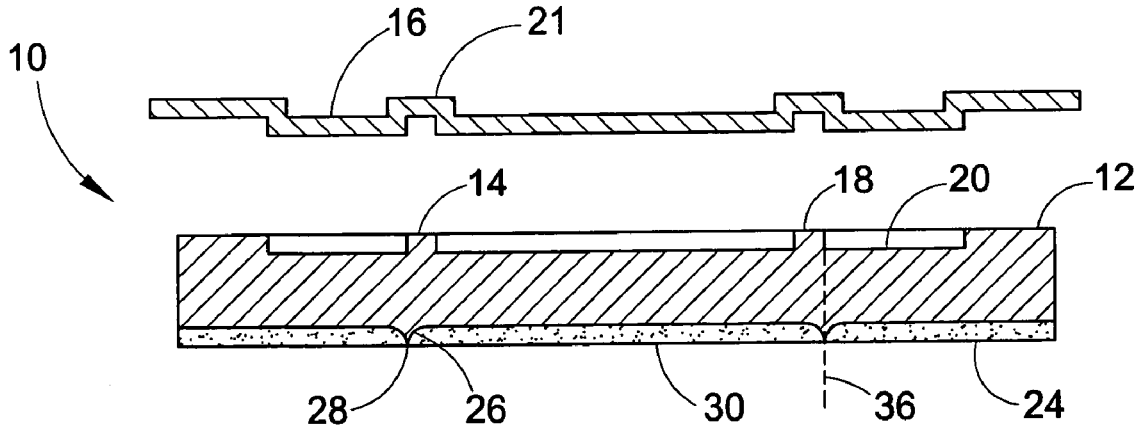
FIG. 2 illustrates a sectional elevational view of the embellishing die shown in FIG. 1 in accordance with the invention.
Figure 3:
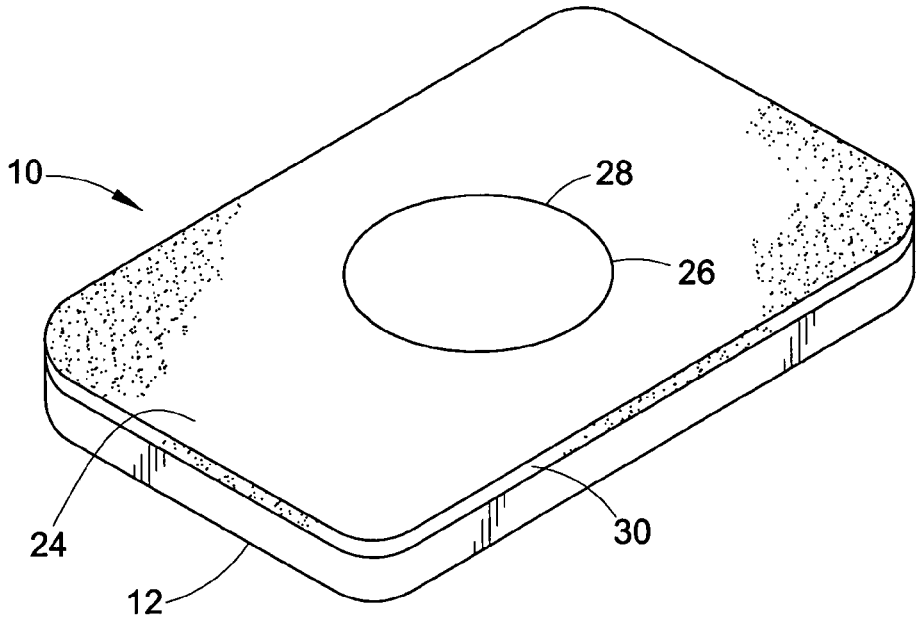
FIG. 3 is a perspective view illustrating an embellishing die in accordance with the invention.

Referring to FIGS. 1–3, a media embellishing die is shown generally at 10. The die 10 includes a first side 12 having a first embellishing surface 14 for embellishing media 16. The first embellishing surface 14 can be an embossing surface for embossing media 16 with a press as described below. The embossing surface 14 can include one or more raised portions 18 extending above an adjacent portion 20 for creating an impression 21 in the media 16. The embossing surface 14 can also include one or more recessed portions 20, recessed relative to the raised portion 18 for creating three dimensional texture in the impression 21. The impression 21 formed by the embossing surface 14 can be a letter, a number, a symbol or any other suitable embossed impression.

The die 10 also includes a second side 24 having a second embellishing surface 26 for embellishing the media 16. The second embellishing surface 26 can be a cutter for cutting media 16 during a pressing operation as described below. The cutter 26 can be formed by a raised portion extending from the surrounding die 10 having an edge 28 capable of cutting the media 16 during a pressing operation. The die 10 can include foam 30 disposed on the second side 24 surrounding the cutter 26 and extending above the die up to the cutter edge 28 to help prevent cutting a person's fingers when handling the die. An example of the foam 30 can include, but is not limited to, closed cell polyethylene.

The die 10 is formed of a rigid material, examples of which include but are not limited to metal such as aluminum or steel, or other rigid materials suitable for forming a die for use in a press 116 as described below. The first and second embellishing surfaces 14, 26 can be formed by machining or casting the die material, or in any other suitable known manner.

Figure 4:
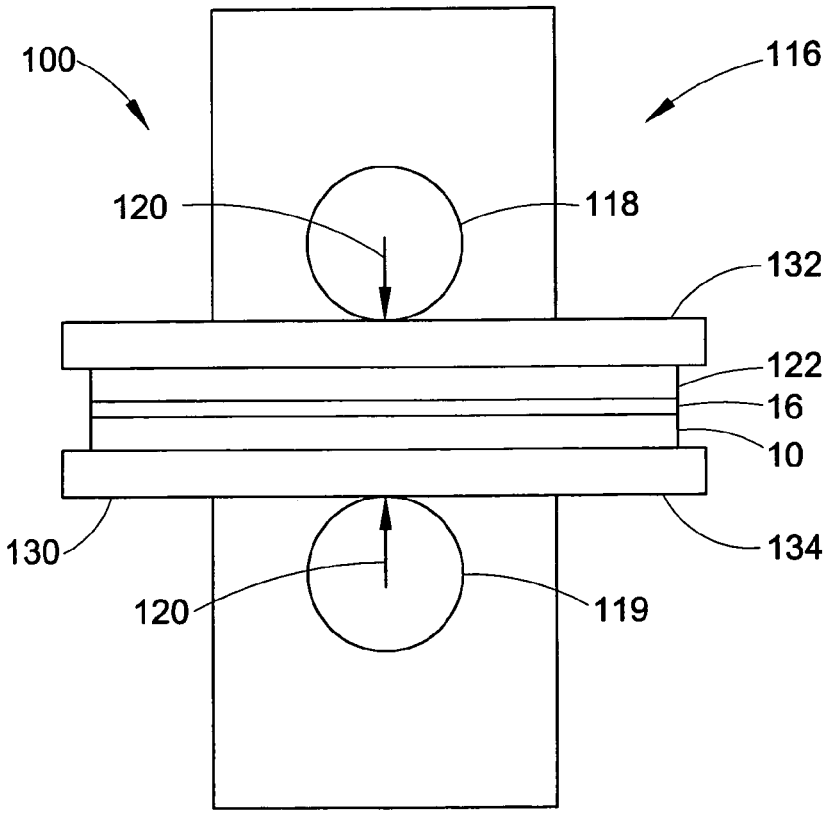
FIG. 4 illustrates a system for embellishing media in accordance with the invention.

Referring to FIG. 4, a system for embellishing media 16 is shown generally at 100. The system 100 includes the embellishing die 10 as described above and a press 116 having first 118 and second 119 press members for applying press forces, shown by arrows 120, during pressing. The press 116 can be a roller press having rollers for press members 118, 119, or any other known press for pressing the media 16 against the embellishing die 10 to embellish the media.

The system 100 can further include an elastomeric embossing pad 122 formed of a resilient, that is, elastic material which deforms when the press forces 120, are applied during pressing and returns to its original shape when the press forces are removed. The embossing pad 122 can be placed against the media 16 and the media can be placed against the embossing surface 14 when the media is embossed by the embossing surface during pressing.

The system 100 can further include a platen plate assembly 130 for distributing the press forces 120 when the press members 118 that are not generally planar, such as roller press members, are used in the press 116. The platen plate assembly 130 can include one or more rigid flat portions, such as a first flat portion 132 and a second flat portion 134. The platen plate assembly 130 is formed of a rigid material, an example of which should not be considered limiting, includes high density polyethylene. The platen plate assembly 130 can be slightly pliable to be capable of regularly coming into contact with the cutter 26 without prematurely dulling it.

Referring now to FIGS. 2 and 4, the first side 12 and second side 16 can be on opposite sides of the die 10. The die 10 is adapted to be pressed together with the media 16 between the first 118 and second 119 press members which apply the press forces 120 to press the media against the die. During pressing, the first side 12 faces one of the first and second press members 118, 119 and the second side 14 faces the other of the first and second press members 118, 119.

The first embellishing surface 14 and second embellishing surface 24 can both be embossing surfaces 14 for embossing media, or cutters 26 for cutting media. The first embellishing surface 14 can be an embossing surface 14 and the second embellishing surface 24 can be a cutter 26.

The first and second embellishing surfaces 14, 24 can be coordinated with each other in type and/or orientation and/or location to embellish the same piece of media 16 in different ways during two different pressings. In one example which should not be considered limiting, the second embellishing surface 24 can be a cutter 26 which is aligned with the first embellishing surface which is an embossing surface 14 as shown by the dashed line 36 in FIG. 2. The embossing surface 14 creates an embossed impression 21 in the media 16 when the media is pressed against it in a first pressing. Then, in the second pressing, the cutter 26 cuts outs the embossed impression 21 to form the embellishment.

Another example of coordinating the first and second embellishing surfaces 14, 24 can include, but is not limited to, using two different embossing surfaces which require different press force characteristics to emboss the media 16 during first and second pressings to produce an embellishment in a single piece of media. The first embossing surface 14 can include a different level of detail, such as finer three dimensional detail, than the second embossing surface 24 which can require different press force characteristics to achieve the best embossing results. Examples of these press force characteristics which can be changed from the first pressing to the second pressing can include, but are not limited to, the magnitude of the press forces 120 generated against the media 16 and embellishing die 10, the magnitude of the pressure applied to the media 16 and embellishing die 10 from the press forces, and the spread of the press forces over the media and embellishing die. One way of creating different press force characteristics in the first and second pressings can include placing different elastomeric embossing pads 122 having different preselected hardnesses against the media 16, and pressing the pad, the media and the embellishing die 10 in the press 116.

Figure 5:
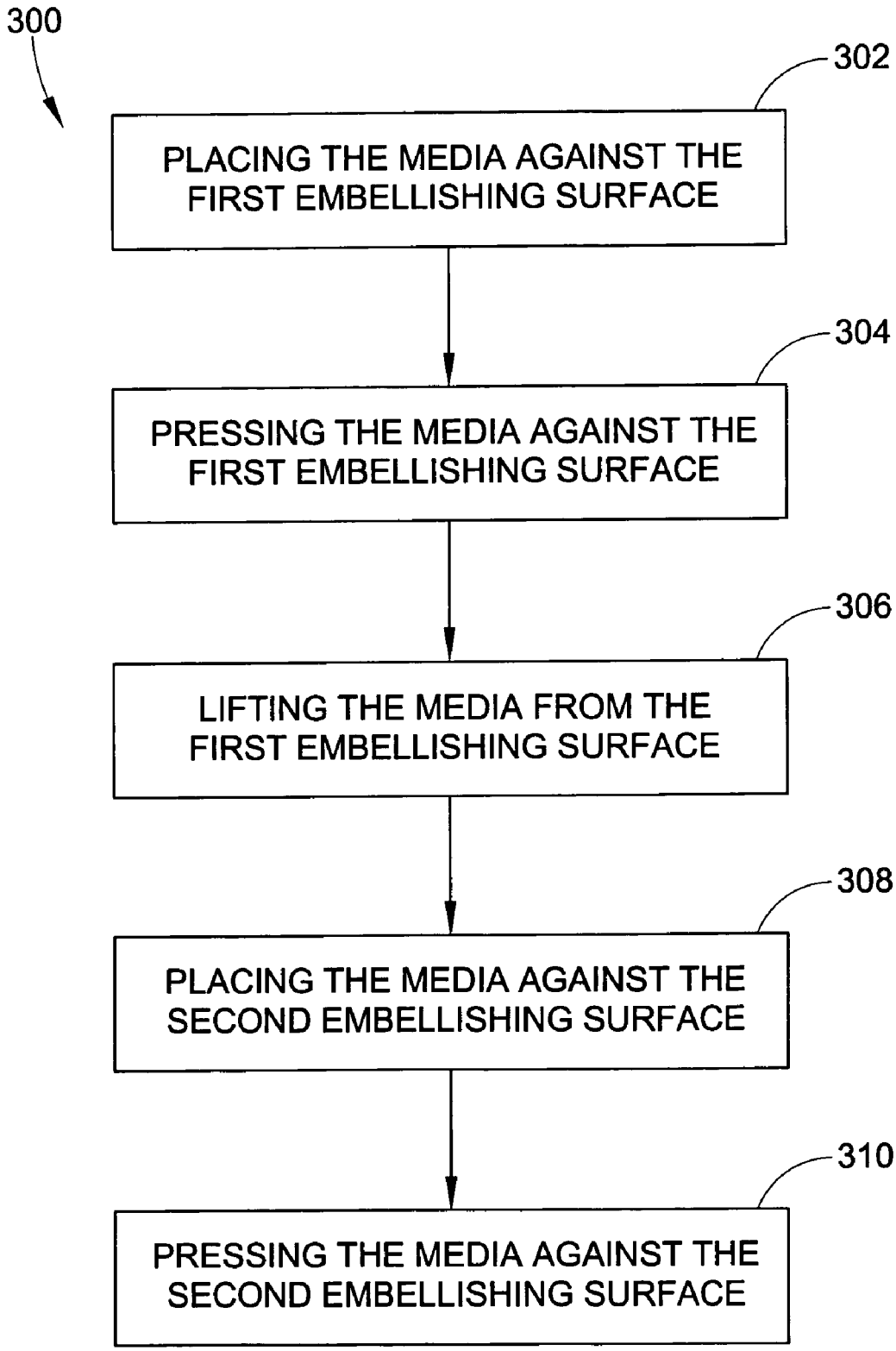
FIG. 5 illustrates a method for embellishing media in accordance with the invention.

Referring to FIG. 5, a method of embellishing media is shown generally at 300. The method 300 includes placing the media 16 against the first embellishing surface 14 on a first side 12 of the media embellishing die 10 at 302. The method 300 also includes pressing the media 16 against the first embellishing surface 14 with the press 116 at 304 to embellish the media. The method 300 also includes lifting the media 16 from the first embellishing surface 14 at 306 and placing the media against the second embellishing surface 26 on a second side 24 of the media embellishing die 10 at 308. The embellishing die 10 can be turned over or the media 16 can be moved to the second side 24 of the embellishing die. The method 300 also includes pressing the media 16 against the second embellishing surface 26 with a press 116 at 310 to embellish the media. The method 300 can also include pressing an elastomeric pad 122 against the media 16 and the media against the first embellishing surface 14 with the press 116 at step 304 to embellish the media. The method 300 can also include pressing an elastomeric pad 122 against the media 16 and the media against the second embellishing surface 24 with the press 116 at step 310 to embellish the media.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

I claim:

1. A media embellishing die for use in a press comprising:

a first side having a first embellishing surface for embellishing media pressed against the first embellishing surface, wherein the first embellishing surface includes an embossing surface for embossing the media; and a second side having a second embellishing surface for embellishing media pressed against the second embellishing surface, wherein the second embellishing surface includes a cutter for cutting the media.

2. The media embellishing die defined in claim 1 wherein the first and second sides are on opposite sides of the die.

3. The media embellishing die defined in claim 1 wherein the first embellishing surface includes a cutter for cutting the media.

4. The media embellishing die defined in claim 1 wherein the second embellishing surface includes an embossing surface for embossing the media.

5. The media embellishing die defined in claim 1 wherein the first and second embellishing surfaces are coordinated with each other in at least one of location and orientation for embellishing the same piece of media in two different pressings.

6. The media embellishing die defined in claim 5 wherein the first embellishing surface is an embossing surface for embossing a media during the first pressing and the second embellishing surface is a cutter aligned with the first embossing surface for cutting the embossed media during the second pressing.

7. The media embellishing die defined in claim 5 wherein the first embellishing surface includes an embossing surface for embossing a media in the first pressing and the second embellishing surface includes an embossing surface for embossing the media in the second pressing, the first and second pressings having different press force characteristics.

8. The media embellishing die defined in claim 1 wherein the media embellishing die is metal.

9. The media embellishing die defined in claim 8 wherein the media embellishing die is aluminum.

10. The media embellishing die defined in claim 8 wherein the media embellishing die is steel.

11. The media embellishing die defined in claim 1 wherein the media embellishing die is formed of a rigid material.

12. A system for embellishing media comprising:

a media embellishing die including a first side having a first embellishing surface for embellishing media pressed against the first embellishing surface and a second side having a second embellishing surface for embellishing media pressed against the second embellishing surface, wherein the first embellishing surface includes an embossing surface for embossing the media and the second embellishing surface includes a cutter for cutting the media; and a press for pressing media against the media embellishing die to embellish the media.

13. The system for embellishing media defined in claim 12 wherein the first and second sides are on opposite sides of the die.

14. The system for embellishing media defined in claim 12 wherein the first embellishing surface includes a cutter for cutting the media.

15. The system for embellishing media defined in claim 12 wherein the second embellishing surface includes an embossing surface for embossing the media.

16. The system for embellishing media defined in claim 12 wherein the press is a roller press.

17. The system for embellishing media defined in claim 12 further comprising an elastomeric embossing pad disposed between the media and the press which deforms during pressing to spread the press forces over the media embellishing die.

18. The system for embellishing media defined in claim 17 further comprising a rigid platen plate for pressing with the media, the media embellishing die and elastomeric pad for distributing the press forces.

19. The system for embellishing media defined in claim 12 wherein the first and second embellishing surfaces are coordinated with each other in at least one of location and orientation for embellishing the same piece of media two different pressings.

20. The system for embellishing media defined in claim 19 wherein the first embellishing surface includes an embossing surface for embossing a media during a first pressing and the second embellishing surface includes a cutter aligned with the first embossing surface for cutting the embossed media during a second pressing.

21. The system for embellishing media defined in claim 20 wherein the first embellishing surface is an embossing surface for embossing a media in a first pressing having first press force characteristics and the second embellishing surface is an embossing surface for embossing the media in a second pressing having second press force characteristics.

22. A method of embellishing media comprising:

placing media against a first embellishing surface of an embellishing die having a first embellishing surface for embellishing media formed on a first side and a second embellishing surface for embellishing media formed on a second side;

pressing the media against the first embellishing surface with a press to embellish the media;

placing the media against the second embellishing surface on the second side of the media embellishing die; and pressing the media against the second embellishing surface with a press to embellish the media.

23. The method defined in claim 22 wherein the first and second embellishing surfaces are on opposite sides of the embellishing die.

24. The method defined in claim 22 wherein the first embellishing surface is an embossing surface and the step of pressing media against the first embellishing surface includes embossing the media.

25. The method defined in claim 22 wherein the second embellishing surface includes a cutter for cutting media and the step of pressing media against the second embellishing surface includes cutting the media.

26. The method defined in claim 22 wherein the first embellishing surface is an embossing surface and the step of pressing media against the first embellishing surface includes embossing the media and the second embellishing surface includes a cutter for culling media and the step of pressing media against the second embellishing surface includes culling the media.

27. The method defined in claim 22 wherein the first embellishing surface is an embossing surface and the step of pressing media against the first embellishing surface includes embossing the media, and the second embellishing surface is an embossing surface and the step of pressing the media against the second embellishing surface includes embossing the media.

28. The method defined in claim 22 wherein the first embellishing surface is a cutter and the step of pressing the media against the first embellishing surface includes cutting the media, and the second embellishing surface is a cutter and the step of pressing the media against the second embellishing surface includes cutting the media.

29. The method defined in claim 22 wherein the first and second embellishing surfaces are coordinated with each other in at least one of location and orientation for embellishing the same piece of media in two different pressings.

30. The method defined in claim 22 wherein the step of pressing the media against the first embellishing surface uses press forces having first press force characteristics, and the step of pressing the media against the second embellishing surface uses press forces having second press force characteristics, the second press force characteristics being different than the first press for characteristics.

* * * * *

UNITED STATES PATENT AND TRADEMARK OFFICE

CERTIFICATE OF CORRECTION

PATENT NO. : 7,055,427 B2
APPLICATION NO. : 10/814004
DATED : June 6, 2006
INVENTOR(S) : James Caron It is certified that error appears in the above-identified patent and that said Letters Patent is hereby corrected as shown below:

Column 6, Line 34 reads --culling--, replace with "cutting"
Column 6, Line 36 reads --culling--, replace with "cutting"
Column 6, Line 60 reads --for--, replace with "force"

Signed and Sealed this

Eighth Day of September, 2009

David J. Kappos

David J. Kappos
*Director of the United States Patent and Trademark Office*